US008861758B2

(12) United States Patent
Klemenz et al.

(10) Patent No.: US 8,861,758 B2
(45) Date of Patent: Oct. 14, 2014

(54) HEARING AID DEVICE AND PROCESSING UNIT AND RECEIVING UNIT FOR THE HEARING AID DEVICE

(75) Inventors: Harald Klemenz, Fürth (DE); Pei Chyi Kristy Lim, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 222 days.

(21) Appl. No.: 12/842,238

(22) Filed: Jul. 23, 2010

(65) Prior Publication Data

US 2011/0019847 A1 Jan. 27, 2011

(30) Foreign Application Priority Data

Jul. 27, 2009 (EP) ..... 09166424

(51) Int. Cl.
*H04R 25/00* (2006.01)

(52) U.S. Cl.
CPC ..... *H04R 25/554* (2013.01); *H04R 25/60* (2013.01); *H04R 2225/63* (2013.01)
USPC ..... 381/312; 381/324

(58) Field of Classification Search
USPC ..... 381/312
See application file for complete search history.

(56) References Cited

U.S. PATENT DOCUMENTS

| | | | | |
|---|---|---|---|---|
| 3,906,170 | A | 9/1975 | Guice | |
| 4,259,547 | A * | 3/1981 | Valley et al. | 381/23.1 |
| 4,564,955 | A * | 1/1986 | Birch et al. | 381/330 |
| 4,912,769 | A | 3/1990 | Erbe | |
| 6,157,728 | A | 12/2000 | Tong et al. | |
| 6,748,094 | B1 | 6/2004 | Tziviskos et al. | |
| 7,447,319 | B2 * | 11/2008 | Miller et al. | 381/60 |
| 8,175,310 | B2 * | 5/2012 | Nielsen et al. | 381/330 |
| 2006/0153418 | A1 * | 7/2006 | Van Halteren | 381/396 |
| 2006/0280324 | A1 * | 12/2006 | Beck et al. | 381/312 |
| 2007/0291971 | A1 * | 12/2007 | Halteren | 381/322 |
| 2008/0002849 | A1 * | 1/2008 | Tan | 381/330 |

(Continued)

FOREIGN PATENT DOCUMENTS

| | | | |
|---|---|---|---|
| EP | 1720377 | A2 | 11/2006 |
| WO | 2006089047 | A2 | 8/2006 |
| WO | 2008010716 | A2 | 1/2008 |
| WO | 2009056167 | A1 | 5/2009 |

OTHER PUBLICATIONS

European Search Report dated Nov. 17, 2009.

*Primary Examiner* — Christopher Uhlir
(74) *Attorney, Agent, or Firm* — Laurence A. Greenberg; Werner H. Stemer; Ralph E. Locher

(57) ABSTRACT

A hearing aid device includes a processing unit and a receiving unit adapted to be coupled to transmit an electrical signal from the processing unit to the receiving unit. The processing unit has a wireless transmitter and a transmitter seal for covering the wireless transmitter and the receiving unit has a wireless receiver and a receiver seal for covering the wireless receiver. The electrical signal is transmitted from the wireless transmitter to the wireless receiver wirelessly. The electrical signal may be transmitted by induction. The transmitter seal and the receiver seal prevent any environmental influences from acting on the hearing aid device and thus protect the hearing aid device from malfunctioning or becoming short circuited. Magnetic connectors and/or mechanical connectors are provided for a stable contact between the processing unit and the receiving unit.

20 Claims, 3 Drawing Sheets

(56) References Cited

U.S. PATENT DOCUMENTS

2008/0170734 A1* 7/2008 Major et al. ..... 381/322
2009/0010465 A1* 1/2009 Boguslavskij et al. ..... 381/315
2009/0041273 A1* 2/2009 Crook ..... 381/322
2009/0262964 A1* 10/2009 Havenith et al. ..... 381/314
2009/0304216 A1* 12/2009 Hansen ..... 381/324
2010/0142740 A1* 6/2010 Roerup ..... 381/330

* cited by examiner

HEARING AID DEVICE AND PROCESSING UNIT AND RECEIVING UNIT FOR THE HEARING AID DEVICE

CROSS-REFERENCE TO RELATED APPLICATION

This application claims the priority, under 35 U.S.C. §119, of European Patent Application EP 09 166 424, filed Jul. 27, 2009; the prior application is herewith incorporated by reference in its entirety.

BACKGROUND OF THE INVENTION

Field of the Invention

The invention generally relates to a hearing aid device. The invention more particularly relates to a processing unit, a receiving unit and a hearing aid device which can be detached into the processing unit and the receiving unit.

A hearing aid device is generally used to increase the loudness of a sound inside the ear of a wearer. In general, a hearing aid device has a microphone which converts an acoustic signal into an electrical signal. The electrical signal is further amplified with the help of an amplifier. The electrical signal is then converted into an acoustic signal which is carried inside the ear, so that the wearer can easily hear the sound.

In general, one type of hearing aid device is a two-part hearing aid device. It includes two elements, one being a processing unit and the other being a receiving unit. The processing unit processes the acoustic signal into the electrical signals to be transmitted further electrically to a receiving unit which further converts the electrical signal into an acoustic signal. The processing unit and the receiving unit are generally modular, but they need to be electrically coupled to transmit the electrical signal. That electrical connection makes the hearing aid device susceptible to malfunctioning of the device due to the external intervention of elements such as water, air, dust, perspiration of the wearer and other such elements. Those elements enter the device through a gap between the processing unit and the receiving unit and in furtherance they enter into connecting openings inside the processing unit and the receiving units. When those elements enter into the openings inside the processing unit and the receiving unit created to connect the two of them, they cause malfunctioning or short circuiting of the device. For example, when the user perspires over the ear or over the head, the perspiration enters into gaps between the processing unit and the receiving unit and it can further seep into openings created for electrical and mechanical openings created inside the processing unit and the receiving unit. Thus, such an entry of the perspiration can create short circuiting or malfunctioning of the device.

One common way to protect the electrical connection is through mechanically fastening the two units, i.e. the processing unit and the receiving unit, so that the gap between the processing unit and the receiving unit is closed. The main problem with that mode of protection is that the closing is still not environmental influence proof. It remains with some miniature holes and the connection could possibly be harmed by moisture or any other such minute environmental disturbances which can enter through miniature openings.

In order to overcome the problems with the permanent seal, it is known to provide a temporary cover for the device. One such construction has been introduced by U.S. Pat. No. 3,906,170. That patent discloses a protective cover for a hearing aid which is hollow and made up of stretchable water proof material. That cover is adjustable to the body of the hearing aid. It has domes to fit onto the controls to permit the adjustment of the controls. The shortcomings of that device are that it is difficult to put the cover on and take the cover off even while changing or charging the batteries. Additionally, once the cover is taken off, the body is again susceptible to environmental disturbances. Even the control adjustments while being in the cover, are not very easy to manage for the user. It makes it even more difficult for the end user to handle the control while he or she is wearing the device, since he or she is not able to see and identify the controls.

SUMMARY OF THE INVENTION

It is accordingly an object of the invention to provide a hearing aid device and a processing unit and a receiving unit for the hearing aid device, which overcome the hereinaforementioned disadvantages of the heretofore-known devices and units of this general type and which reduce the risk of environmental influence harming a two-part hearing aid device.

With the foregoing and other objects in view there is provided, in accordance with the invention, a processing unit for a hearing aid device. The processing unit comprises a coupling adapted to couple the processing unit to a receiving unit, a wireless transmitter adapted to transmit an electrical signal to the receiving unit wirelessly, and a transmitter seal for covering the wireless transmitter.

In accordance with another preferred feature of the invention, the wireless transmitter is an inductive transmitter which is adapted to transmit an electrical signal to the receiving unit by induction.

With the objects of the invention in view, there is also provided a receiving unit for a hearing aid device. The receiving unit comprises a coupling adapted to couple the receiving unit to a processing unit, a wireless receiver adapted to receive an electrical signal from the processing unit wirelessly, and a receiver seal for covering the inductive receiver.

In accordance with a further preferred feature of the invention, the wireless receiver is an inductive receiver which is adapted to receive an electrical signal from the processing unit by induction.

With the objects of the invention in view, there is furthermore provided a hearing aid device, comprising a processing unit having a wireless transmitter and a transmitter seal for covering the wireless transmitter, and a receiving unit having a wireless receiver and a receiver seal for covering the wireless receiver. The processing unit and the receiving unit are adapted to be coupled together to wirelessly transmit an electrical signal from the wireless transmitter of the processing unit to the wireless receiver of the receiving unit.

In accordance with a concomitant preferred feature of the invention, the wireless transmitter is an inductive transmitter and the wireless receiver is an inductive receiver and the electrical signal is transmittable from the wireless transmitter to the wireless receiver by induction.

The invention is based on the concept of using a wireless signal transmission from the processing unit to the receiving unit and of sealing the units of the hearing aid at the wireless transmitter and wireless receiver, respectively, to reduce the number of openings to the hearing aid for the purpose of signal transmission between the two units. This allows a reduction of the risk of environmental influences such as water or dust or perspiration of the wearer entering a two-part or bipartite construction of the hearing aid.

Other features which are considered as characteristic for the invention are set forth in the appended claims.

Although the invention is illustrated and described herein as embodied in a hearing aid device and a processing unit and a receiving unit for the hearing aid device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
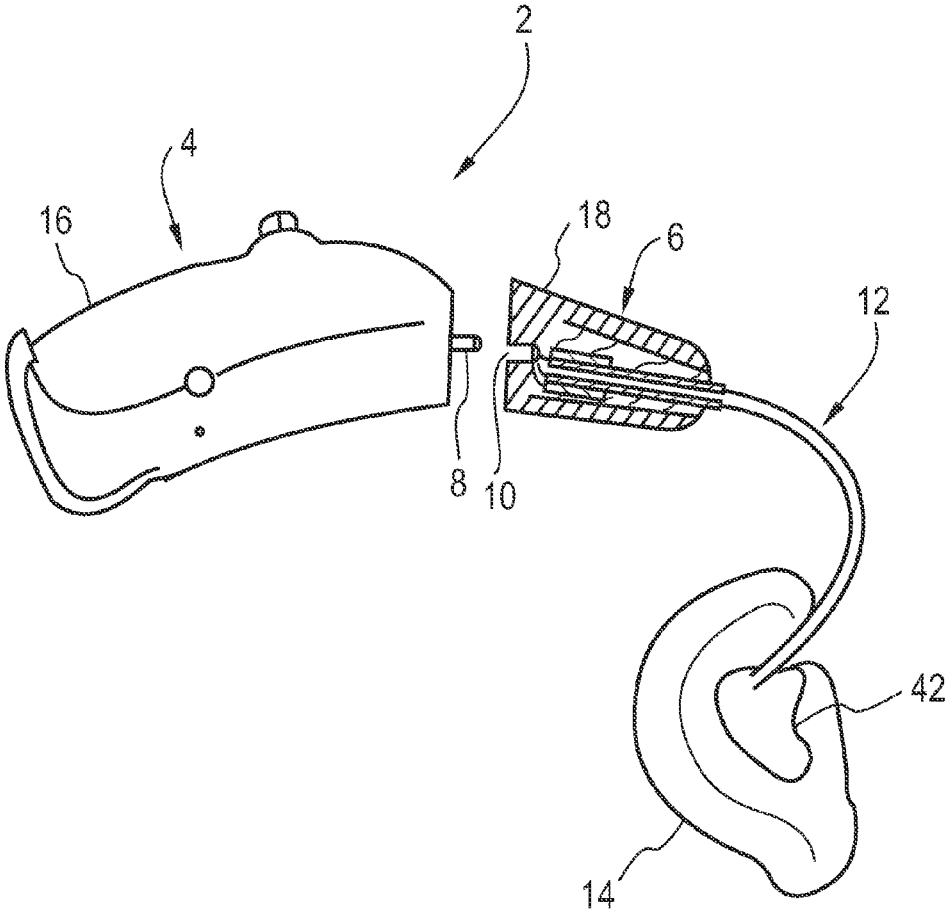
FIG. 1 PRIOR ART
FIG. 1 is a diagrammatic, partly-sectional, side-elevational view of a hearing aid device according to the prior art.

Referring now to the figures of the drawings in detail and first, particularly, to FIG. 1 thereof, there is seen one type of hearing aid device 2 according to the prior art. The hearing aid device 2 has two modular components, i.e. a processing unit 4 and a receiving unit 6. These two units 4, 6 are connected together in the form of an electrical plugging system. The plugging system includes a male plug part 8 and a female plug part 10. When the male plug part 8 is inserted into the female plug part 10, an electrical connection is established. With the establishment of the electrical connection, an electrical signal is transferred from the processing unit 4 to the receiving unit 6.

The processing unit 4 converts acoustic signals into the electrical signal with the help of a microphone and the electrical signal is further amplified to increase its strength with the help of an amplifier.

The hearing aid device 2, which is shown, is in the form of a Behind the Ear (BTE) device. However, it can also be in the form of an In the Ear (ITE) unit or an In the Canal (ITC) or a Receiver in the Canal/Ear (RTC/RTE) or an Inside the Canal (ITC) or a Completely Inside the Canal (CIC) or any other similar hearing aid device.

The receiving unit 6 converts the electrical signal received from the processing unit 4 to an acoustic signal, which is further carried through a hollow tonal tube 12 and an ear plug 42 to an ear 14 of the wearer.

The problem with the two-part type of hearing aid device is that the electrical connection which is established through a plugging system is susceptible to multiple influences from the environment, such as water, air, moisture, dust, etc. When the electrical connection is established by plugging the male plug 8 into the female plug 10, there are still some gaps left between the processing unit 4 and the hearing unit 6. The electrical connection is open to external environmental influences at those gaps. Those environmental influences enter into the gaps between the processing unit and the receiving unit and lead to reduced functionality or malfunctioning or short circuiting of the hearing aid device.

Figure 2:
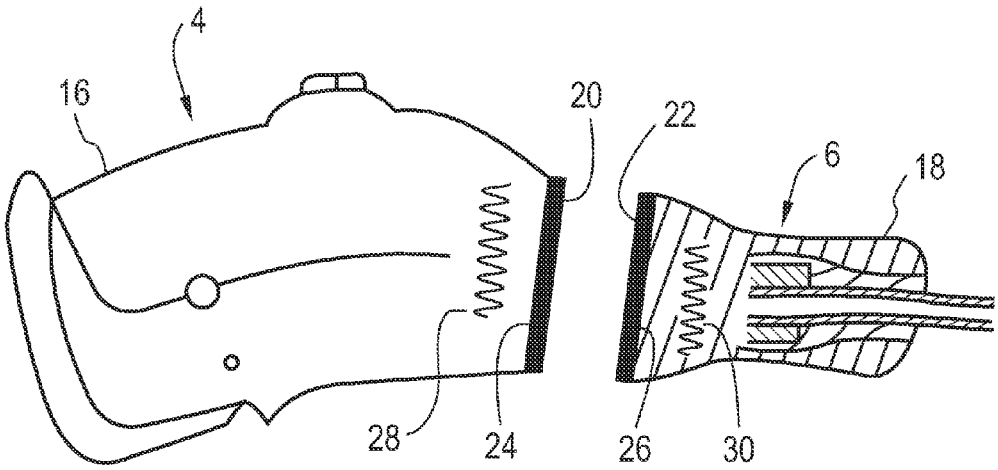
FIG. 2 is an enlarged, partly-sectional, side-elevational view of a hearing aid device according to an embodiment of the invention, showing a sealed processing unit and a sealed receiving unit, being wirelessly coupled.

FIG. 2 shows a hearing aid device according to an embodiment of the invention. The hearing aid device 2 has a processing unit 4 and a receiving unit 6.

The processing unit 4 has a housing 16 and a wireless transmitter 28 inside the housing. A transmitter seal 20 is provided at a surface 24 of the processing unit 4 to cover the wireless transmitter 28.

The receiving unit 6 has a housing 18 and a wireless receiver 30 inside the housing. A receiver seal 22 is provided at a surface 26 of the receiving unit 6 to cover the wireless receiver 30.

The seal 20 covering the wireless transmitter 28 and the seal 22 covering the wireless receiver 30 protect the electrical connection between the two units of the hearing aid, i.e., the processing unit 4 and the receiving unit 6. An electrical connection is established between the processing unit and the receiving unit with the help of a wireless transmitter and a wireless receiver, namely the wireless transmitter 28 and the wireless receiver 30. The electrical transmission from the processing unit 4 to the receiving unit 6 is now therefore maintained through a wireless connection occurring between both the wireless transmitter and the wireless receiver 28, 30.

The function of the transmitter seal 20 and the receiver seal 22 is to protect the wireless transmitter 28 and the wireless receiver 30 from any environmental influences such as water, air, dust, the wearer's perspiration or the like. In this way, the processing unit and the receiving unit are protected from any malfunction or short circuit.

The seals 20, 22 are adapted to advantageously seal a portion of the surfaces 24, 26 of the housings 16, 18 to cover an opening inside of which the wireless transmitter and the wireless receiver 28, 30 are placed. The openings are easy to cover, since it just requires the seals 20, 22 to be fixed externally on the surfaces 24, 26. Thus, the seals could be made separately and whenever a seal is tampered with or destroyed in a certain way, a new seal could be fixed to the surfaces 24, 26. Thus, such an embodiment allows the seals 20, 22 to be replaced easily and provides a benefit for maintenance as well. The seals 20, 22 can also be provided at other portions of the surfaces 24, 26, so that the entire surfaces 24, 26 of the housing 16, 18 can be covered, leaving the mandatory openings for battery charging, battery case, sound capturing or any other relevant functions which are desired for the functioning of the hearing aid device.

The seals 20, 22 are fixed to the surfaces 24, 26 by any temporary fixing mechanisms, such as adhesives or glues or the like. The seals 20, 22 can also be permanently stuck to the surfaces 24, 26 of the housings 16, 18 or the seals 20, 22 could also be made as a part of the surfaces 24, 26 of the housings 16, 18 or the seals 20, 22 could also be a part of the housings 16, 18 or the seals 20, 22 could also function as the surfaces 24, 26.

The processing unit 4 converts acoustic signals into electrical signals, these electrical signals are transmitted into the receiving unit 6 wirelessly and these electrical signals are further converted into acoustic signals and transmitted inside the ear 14 through the tonal tube 12.

In an embodiment where the wireless transmitter 28 is an inductive wireless transmitter 28 and the wireless receiver 30 is an inductive wireless receiver 30, the inductive wireless transmitter 28 generates a magnetic field when the electrical signal is passed into it. The inductive wireless receiver 30 detects the magnetic field generated by the inductive wireless transmitter 28 and the electrical signal flow starts in the inductive wireless receiver 30. This process of generating a magnetic field by the inductive wireless transmitter 28 and detecting the magnetic field by the inductive wireless receiver 30 is called magnetic induction. An electrical coupling is established between the processing unit 4 and the receiving unit 6 by creating magnetic induction between the inductive wireless transmitter 28 and the inductive wireless receiver 30.

In the embodiment based on inductive transmission, the electrical signal is transferred from the inductive wireless transmitter 28 to the inductive wireless receiver 30 through magnetic induction. The magnetic induction occurs when a magnetic field is generated by the inductive wireless transmitter 28 and detected by the inductive wireless receiver 30 causing the electrical signal to flow. The electrical signal is transmitted by the inductive wireless transmitter 28 through a fluctuation of the magnetic field, which induces an electric current in the inductive wireless receiver 30.

In the embodiment based on induction, the inductive wireless transmitter and the inductive wireless receiver 28, 30 preferably are in the form of coils, i.e. a transmitting inductive coil and a receiving inductive coil, respectively, or any other possible structure or shape, so as to perform the function of magnetic induction. The coils can be disposed in parallel to each other. Preferably, the coils can be disposed coaxial to each other. The inductive wireless transmitter and the inductive wireless receiver 28, 30 in the form of coils make the inductive wireless transmitter and the inductive wireless receiver 28, 30 compact, since smaller and lighter inductive coils could be used in place of other inductive structures to provide efficient and systematic electrical current flow inside the electrical coupling. In a further beneficial embodiment, the coils can be coaxial and overlap each other, i.e. one coil can have a smaller diameter than the other coil, the larger coil can have an at least partly free inner perimeter and the smaller coil can be positioned at least partly inside the free perimeter of the larger coil for wirelessly inductively transmitting signals.

Other embodiments can use other wireless transmission technologies, such as WLAN-broadcasting (Wireless Local Area Network), WPLAN-broadcasting (Wireless Personal Area Network), optical transmission using LEDs and photodetectors. These embodiments might require the receiving unit 6 to include a power supply of its own. For embodiments where the receiving unit 6 does not include a power source, induction is a preferred transmission technology since induction is well suited to transmit operating power as well as electrical information to the receiving unit 6.

The processing unit 4 and the receiving unit 6 are advantageously made to contact each other, in order to function as a hearing aid device. This contact is established by providing a shape to the surface 24 of the processing unit 4 and the surface 26 of the receiving unit 6, so that both of the surfaces 24, 26 can be aligned properly. The shape of both of the surfaces 24, 26 can be symmetrical or asymmetrical or complimentary to provide easy alignment, but the shape can also be just sufficient to make them function as a hearing aid device 2 and need not be limited to any alignment or symmetry or asymmetry or complimentary structure. By providing the surface 24 of the processing unit 4 and the surface 26 of the receiving unit 6 with matching surface shapes, the surfaces 24, 26 are in contact over a substantial part of the respective surface areas 24, 26, so that the receiving unit 4 can be easily made to contact the processing unit and both units 4, 6 are properly aligned.

The processing unit 4 is provided with such a shape that it is adaptable to be placed behind the ear of the wearer and the wearer can wear it for many hours continuously without fatigue. The benefit of this type of embodiment is that the processing unit can be carried near the ear and no separate extended wiring is required to keep the processing unit in place. Additionally, it is inexpensive, since less wiring is required.

Figure 3:
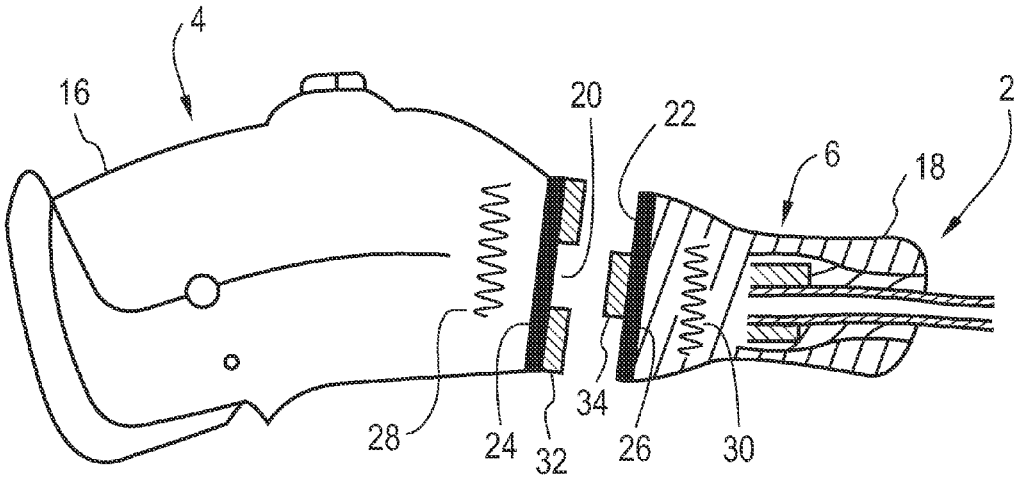
FIG. 3 is a partly-sectional, side-elevational view of a hearing aid device according to another embodiment of the invention, showing the sealed processing unit and the sealed receiving unit being wirelessly coupled and mechanically connected.

FIG. 3 shows a hearing aid device 2 according to another embodiment of the invention. The figure shows a connection configuration between the processing unit 4 and the receiving unit 6. The processing unit 4 and the receiving unit 6 are provided with complimentary or matching mechanical connectors 32, 34. This type of embodiment has the advantage of providing a strong and regular connection mechanism between the processing unit 4 and the receiving unit 6. Another advantage is that the connectors can be externally provided on the surface, so that in case of damage to the connectors, they can be easily replaced. On the other hand, if they are made a part of the housings 16, 18 or the surfaces 24, 26 or the seals 20, 22, then they eliminate a manufacturing step. The processing unit 4 has a self-tightening clamping part 32, while the receiving unit 6 has a holding part 34. The parts can also be provided in the opposite locations, i.e. the processing unit 4 can have the holding part 34 and the receiving unit 6 can have the self-tightening clamping part 32. When the holding part 34 is inserted into the self-tightening clamping part 32, the self-tightening clamping part 32 automatically stretches or extends outwards to provide an entry for the holding part 34 inside the clamping part 32 and as the holding part 34 enters inside, the tightening clamping part 32 tightens around the holding part 34. The self-tightening clamping part 32 and the holding part 34, preferably, can have grooves or threads to provide a better grip between them when they are in the inserted position. This mechanical connecting configuration provides a stable contact to the surfaces 24, 26 of the housings 16, 18 of the processing unit 4 and the receiving unit 6 through these mechanical connectors 32, 34. The mechanical connectors 32, 34 can also be threaded fasteners, clamps, clips, adhesives, hook and loop fasteners such as Velcros®, friction locks and the like or a combination of any of these.

Figure 4:
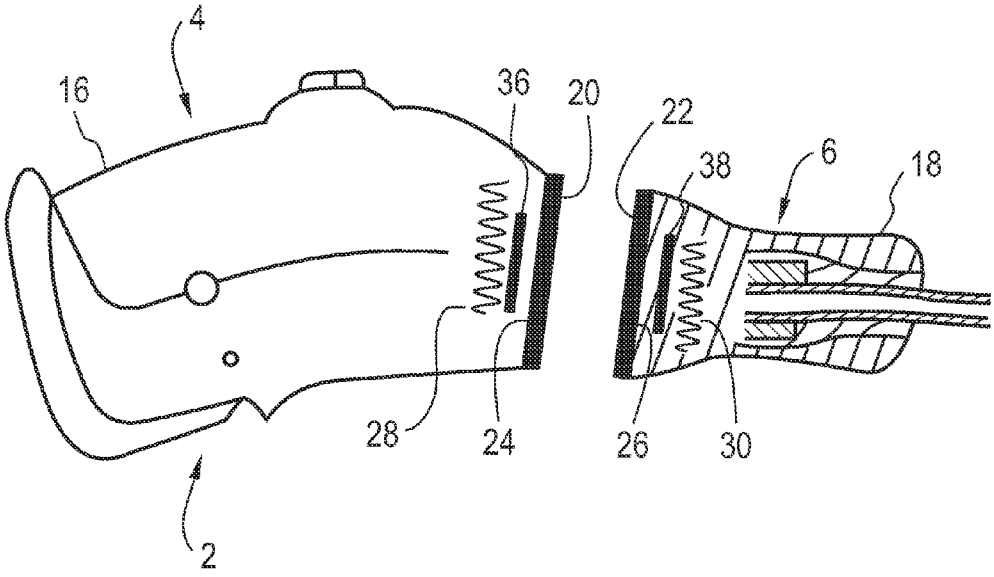
FIG. 4 is a partly-sectional, side-elevational view of a hearing aid device according to a further embodiment of the invention, showing the sealed processing unit and the sealed receiving unit being wirelessly coupled and magnetically connected.

FIG. 4 shows a hearing aid device 2 according to another embodiment of the invention. The figure shows a connection configuration between the processing unit 4 and the receiving unit 6. The processing unit 4 and the receiving unit 6 are provided with complimentary or matching magnetic connectors 36, 38. The magnetic connection configuration is preferred since it provides an easy attaching and detaching mechanism. The magnetic connectors 36, 38 also aid in the easy placement and guidance of the processing unit 4 and the receiving unit 6 at the time of connection. They can be replaced in case of damage thereto if placed externally outside the surfaces 24, 26 or made part of the seals 20, 22 or placed on the seals 20, 22. The magnetic connector 36 is provided inside the surface 24 of the processing unit 4, while the other magnetic connector 38 is provided inside the surface 26 of the receiving unit 6. The magnetic connectors 36, 38 can advantageously be provided on the surfaces 24, 26 of the housings 16, 18 or they 36, 38 can also become a part of the seals 20, 22 or they can also function as the seals 36, 38. Such an embodiment eliminates one manufacturing step.

When the processing unit 4 and the receiving unit 6 are each brought towards the magnetic field of the other magnetic connector 36, 38, a magnetic connection is established to provide a stable contact to the surfaces 24, 26 of the housings 16, 18 of the processing unit 4 and the receiving unit 6.

Figure 5:
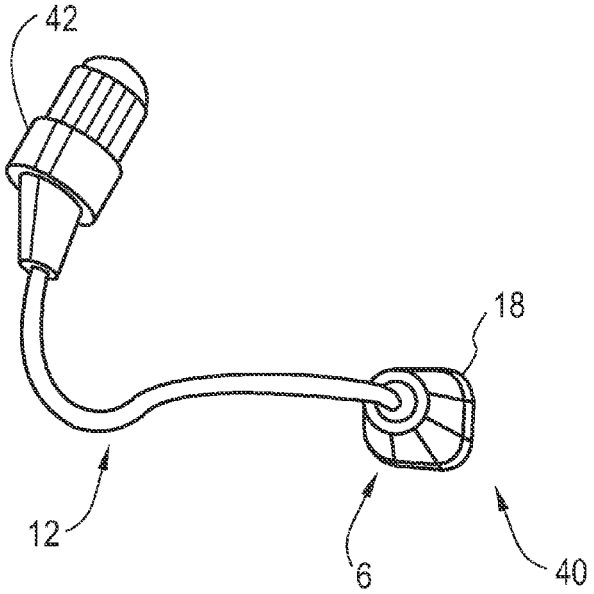
FIG. 5 is a perspective view of a receiving unit of a hearing aid device according to an additional embodiment of the invention, showing the receiving unit in the shape of a physical plug.

FIG. 5 shows a receiving unit 6 of the hearing aid device 2 according to another embodiment of the invention. The receiving unit 6 also includes a physical plug 40 which connects the receiving unit 6 to the processing unit 4. The physical plug 40 also has a housing 18 and a surface 26, inside which the wireless receiver 30 is placed. The physical plug 40 advantageously provides an easy connecting mechanism for the receiving unit 6 to the processing unit 4. Another advantage is that the plug helps to guide the processing unit 4 inside the receiving unit 6, so that the user can easily place the receiving unit 4 and the processing unit 6 together. The plug 40 also helps to detach the processing unit 4 from the receiving unit 6. After the electrical signal is converted into the acoustic signal in the receiving unit 6, it is carried further through the tonal tube 12 to the ear plug 42. The ear plug 42 is placed inside the ear, so that the sound is prevented from being leaked and enters directly into the ear.

A coupling 20, 22; 32, 34; 36, 38; 40 is thus provided in each embodiment of the invention for coupling the processing unit 4 and the receiving unit 6 to each other.

The invention claimed is:

1. A processing unit for a hearing aid device, the processing unit comprising:

a behind the ear processing unit housing;

a coupling connected to said processing unit housing and configured for coupling the processing unit housing directly to a receiving unit housing of a receiving unit to be worn behind an ear;

a wireless transmitter disposed inside said behind the ear processing unit housing and configured for transmitting an electrical signal to the receiving unit wirelessly while the receiving unit housing is being worn behind the ear; and a transmitter seal for covering said wireless transmitter and sealing said behind the ear processing unit housing at said wireless transmitter.

2. The processing unit according to claim 1, wherein said wireless transmitter is an inductive transmitter adapted to transmit an electrical signal to the receiving unit by induction.

3. The processing unit according to claim 2, wherein said wireless transmitter includes a transmitting inductive coil adapted to generate a magnetic field to transmit the electrical signal.

4. The processing unit according to claim 1, which further comprises a transmitter seal adapted to seal a portion of a surface of the processing unit.

5. The processing unit according to claim 1, wherein a surface of the processing unit has a shape adapted to be physically aligned to a surface of the receiving unit.

6. The processing unit according to claim 1, wherein said coupling is a mechanical connector adapted to attach the receiving unit to the processing unit.

7. The processing unit according to claim 1, wherein said coupling is a magnetic connector adapted to attach the receiving unit to the processing unit.

8. The processing unit according to claim 1, wherein the processing unit is adapted to be placed behind the ear.

9. A receiving unit for a hearing aid device, the receiving unit comprising:

a receiving unit housing for being worn behind an ear;

a coupling connected to said housing and configured for coupling the receiving unit housing directly to a behind the ear processing unit;

a wireless receiver disposed inside said housing and configured for receiving an electrical signal from the processing unit wirelessly while the receiving unit housing is being worn behind the ear; and a receiver seal for covering said wireless receiver and sealing said housing at said wireless receiver.

10. The receiving unit according to claim 9, wherein said wireless receiver is an inductive receiver adapted to receive an electrical signal from the processing unit by induction.

11. The receiving unit according to claim 10, wherein said wireless receiver includes a receiving inductive coil adapted to detect a magnetic field for receiving the electrical signal.

12. The receiving unit according to claim 9, which further comprises a physical plug adapted to be connected to the processing unit.

13. The receiving unit according to claim 9, which further comprises a receiver seal adapted to seal a portion of a surface of the receiving unit.

14. The receiving unit according to claim 9, wherein a surface of the receiving unit has a shape adapted to be physically aligned to a surface of the processing unit.

15. The receiving unit according to claim 9, wherein said coupling is a mechanical connector adapted to attach the processing unit to the receiving unit.

16. The receiving unit according to claim 9, wherein said coupling is a magnetic connector adapted to attach the processing unit to the receiving unit.

17. A hearing aid device, comprising:

a processing unit having a processing unit housing, a wireless transmitter disposed inside said processing unit housing and a transmitter seal for covering said wireless transmitter and sealing said processing unit housing at said wireless transmitter; and a receiving unit having a receiving unit housing, a wireless receiver disposed inside said receiving unit housing and a receiver seal for covering said wireless receiver and sealing said receiving unit housing at said wireless receiver;

said processing unit and said receiving unit being configured for being coupled together for wirelessly transmitting an electrical signal from said wireless transmitter of said processing unit to said wireless receiver of said receiving unit; and an ear plug for being disposed in an ear and receiving an acoustic signal from said receiving unit, said ear plug being connected to said receiving unit by a tonal tube which carries the acoustic signal to said ear plug.

18. The hearing aid device according to claim 17, wherein said processing unit includes a coupling configured to couple the processing unit to a receiving unit.

19. The hearing aid device according to claim 17, wherein said receiving unit includes a coupling adapted to couple the receiving unit to a processing unit.

20. The hearing aid device according to claim 17, wherein:

said processing unit having said wireless transmitter adapted to transmit an electrical signal to said receiving unit wirelessly and said transmitter seal for covering said wireless transmitter, includes a coupling adapted to couple said processing unit to said receiving unit; and said receiving unit having said wireless receiver adapted to receive an electrical signal from said processing unit wirelessly and said receiver seal for covering said wireless receiver, includes a coupling adapted to couple said receiving unit to said processing unit.

* * * * *